US011194271B2

(12) United States Patent
Fujimoto

(10) Patent No.: US 11,194,271 B2
(45) Date of Patent: Dec. 7, 2021

(54) CYLINDRICAL FILM AND IMAGE HEATING APPARATUS

(71) Applicant: CANON KABUSHIKI KAISHA, Tokyo (JP)

(72) Inventor: Tetsuichiro Fujimoto, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 176 days.

(21) Appl. No.: 16/558,846

(22) Filed: Sep. 3, 2019

(65) Prior Publication Data

US 2020/0073302 A1 Mar. 5, 2020

(30) Foreign Application Priority Data

Sep. 4, 2018 (JP) ..... JP2018-165361

(51) Int. Cl.
*G03G 15/20* (2006.01)
*H05B 6/14* (2006.01)

(52) U.S. Cl.
CPC ..... *G03G 15/2053* (2013.01); *H05B 6/145* (2013.01)

(58) Field of Classification Search
CPC ..... G03G 15/2053; G03G 2215/2035; G03G 15/2057
See application file for complete search history.

(56) References Cited

U.S. PATENT DOCUMENTS 5,869,808 A * 2/1999 Hyllberg ..... G03G 15/2053 219/216
6,573,485 B2 6/2003 Yokozeki
2006/0153605 A1* 7/2006 Nishiyama ..... G03G 15/2042 399/329
2009/0047048 A1* 2/2009 Ikeda ..... G03G 15/2057 399/333
2013/0243463 A1* 9/2013 Kanai ..... G03G 15/2039 399/67
2014/0178110 A1* 6/2014 Yagi ..... G03G 15/1605 399/302

FOREIGN PATENT DOCUMENTS

JP 2003-017237 A 1/2003
JP 2005-093352 A 4/2005
JP 2015-118232 A 6/2015
JP 2015118232 A * 6/2015

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

A cylindrical film for use with an image heating apparatus includes a plurality of heat generating elements configured to generate heat by a flow of a current, in which each of the heat generating elements has a ring shape and is arranged along a longitudinal direction of the film; a ring-shaped insulating portion configured to electrically insulate the heat generating elements adjacent to each other; and a heat conductive layer different from a layer of the heat generating elements with respect to a thickness direction of the film, The heat conductive layer is 3 W/mK or more in thermal conductivity and overlaps with the heat generating elements with respect to the longitudinal direction.

11 Claims, 11 Drawing Sheets

CYLINDRICAL FILM AND IMAGE HEATING APPARATUS

FIELD OF THE INVENTION AND RELATED ART

The present invention relates to a cylindrical film and an image heating apparatus, such as a fixing unit mountable in a copying machine or a printer of an electrophotographic type, particularly an image heating apparatus of an electromagnetic induction heating type.

In recent years, the image heating apparatus of the electromagnetic induction heating type in which a heat generating layer of a rotatable heat generating member can be directly heated has been proposed. Here, when breakage such as a crack occurs in the rotatable heat generating member of the electromagnetic induction heating type, heat generation concentrated at a breakage end portion and a temperature locally increased (overheating) is some cases. There is a possibility that the local temperature rise causes image defects such as image non-uniformity and a hot offset. Further, in a constitution in which a current flows in a circumferential direction of the rotatable heat generating member, when the breakage such as the cracks occurs with respect to a longitudinal direction of the rotatable heat generating member, the local temperature rise at the breakage end portion becomes more conspicuous by the influence of the current flowing in the circumferential direction.

In the case where the crack or the like generates in the rotatable heat generating member, in order to suppress the overheating of the rotatable heat generating member, a constitution in which a heat generating layer of the rotatable heat generating member is electrically divided with respect to the longitudinal direction of the rotatable heat generating member has been proposed (Japanese Laid-Open Patent Application (JP-A) 2015-118232). In JP-A 2015-118232, a constitution in which individual divided heat generating layers overlap with each other with respect to the longitudinal direction of the rotatable heat generating layer and a constitution in which the individual divided heat generating layers do not overlap with each other with respect to the longitudinal direction are disclosed.

However, the rotatable member disclosed in JP-A 2015-118232 involves a problem such that temperature non-uniformity of the rotatable member is liable to occur.

A principal object of the present invention is to provide a cylindrical film and an image heating apparatus of the electromagnetic induction heating type, capable of compatibly realizing easily suppression of overheating in the case where the crack or the like generates in a cylindrical rotatable member as the rotatable heat generating member and suppression of an occurrence of an image defect due to the temperature non-uniformity with respect to the longitudinal direction of the rotatable member.

SUMMARY OF THE INVENTION

According to an aspect of the present invention, there is provided a cylindrical film for use with an image heating apparatus, comprising:

a plurality of heat generating elements configured to generate heat by a flow of a current, wherein each of the heat generating elements has a ring shape and is arranged along a longitudinal direction of the film; a ring-shaped insulating portion configured to electrically insulate the heat generating elements adjacent to each other; and a heat conductive layer different from a layer of the heat generating elements with respect to a thickness direction of the film, wherein the heat conductive layer is 3 W/mK or more in thermal conductivity and overlaps with the heat generating elements with respect to the longitudinal direction of the film.

According to another aspect of the present invention, there is provided an image heating apparatus for heating an image formed on a recording material, comprising: a cylindrical film rotatable while contacting the recording material; a roller contacting an outer surface of the film and configured to form a nip, in which the recording material is nipped and fed, between itself and the film; and an exciting coil unit configured to generate an induced current flowing through the film in a circumferential direction, wherein the film includes, a plurality of heat generating elements configured to generate heat by a flow of the induced current, each of the heat generating elements has a ring shape and is arranged along a longitudinal direction of the film; a ring-shaped insulating portion configured to electrically insulate the heat generating element adjacent to each other; and a heat conductive layer different from a layer of the heat generating elements with respect to a thickness direction of the film, wherein the heat conductive layer is 3 W/mK or more in thermal conductivity and overlaps with the heat generating elements with respect to a longitudinal direction.

Further features of the present invention will become apparent from the following description of exemplary embodiments with reference to the attached drawings.

BRIEF DESCRIPTION OF THE DRAWINGS

Parts (a), (b) and (c) of FIG. 1 are sectional views of a fixing film.

Figure 5:
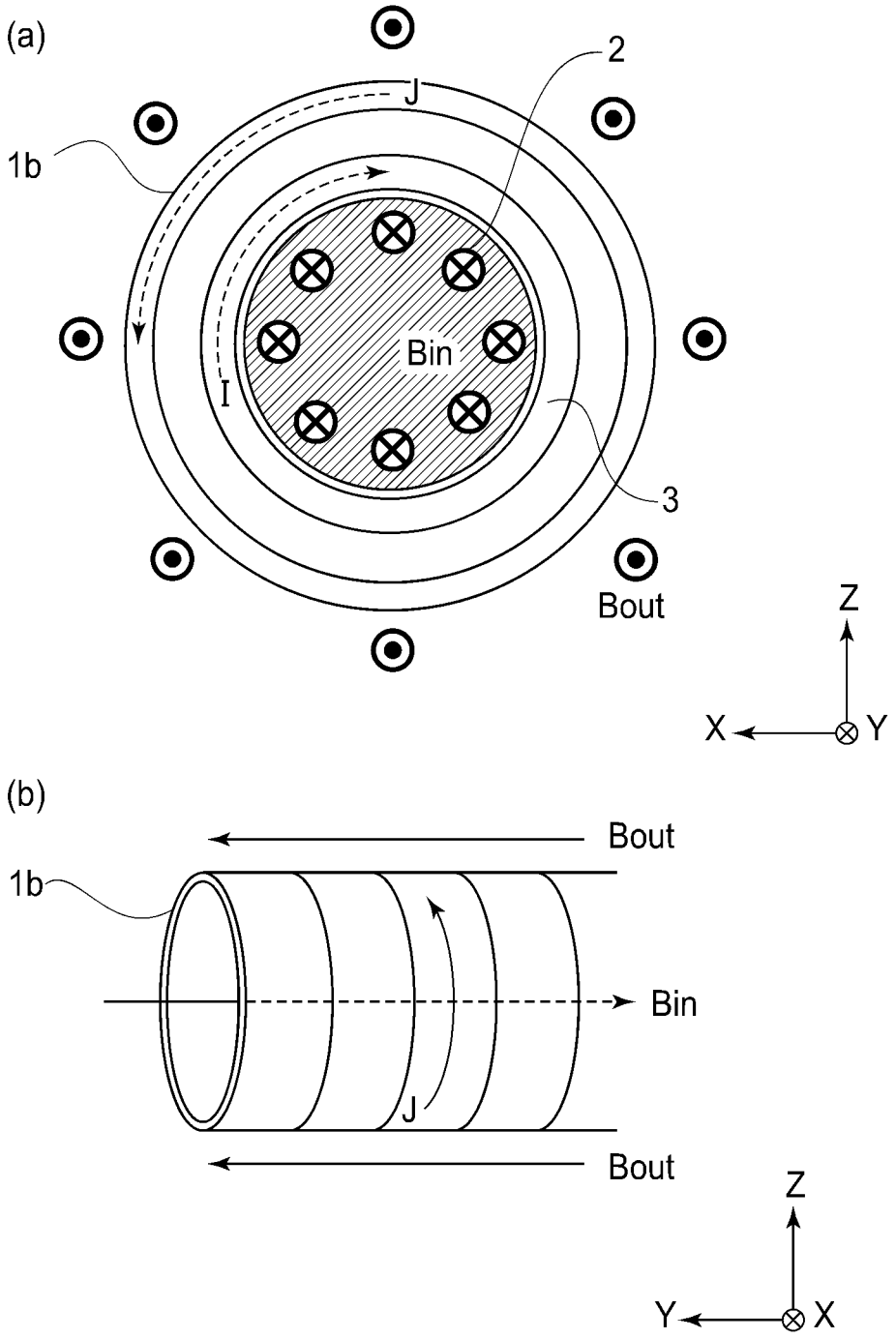

Parts (a) and (b) of FIG. 5 are schematic views showing a relationship between an induced conductive flowing through a heat generating layer and a magnetic field.

Figure 6:
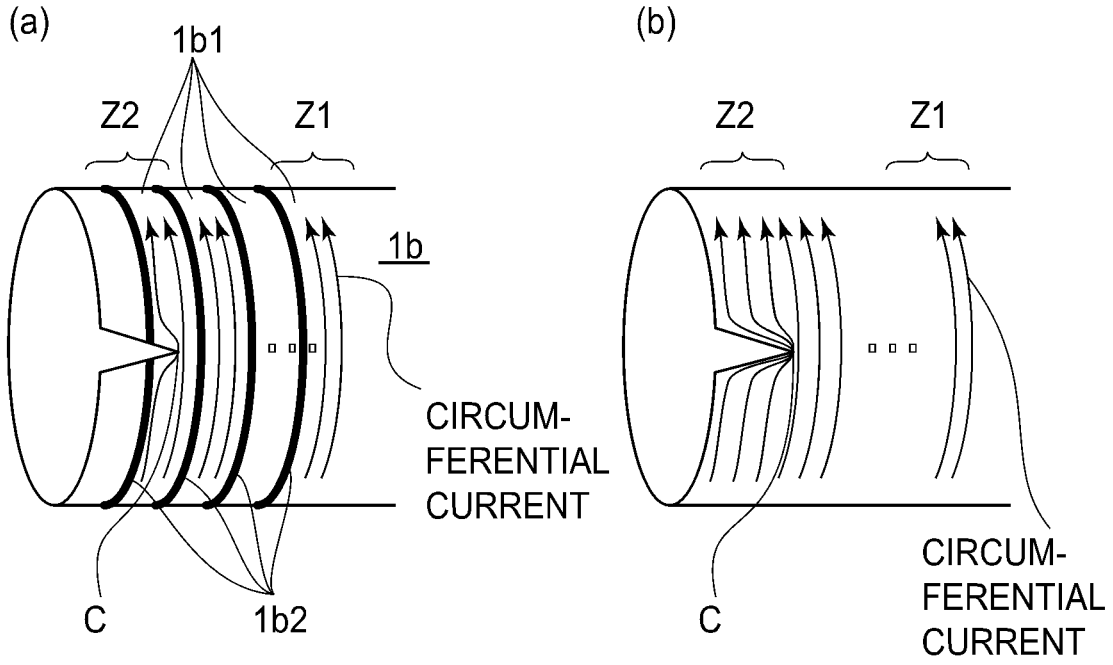

Parts (a) and (b) of FIG. 6 are schematic views for illustrating a difference in current between occurrence and non-occurrence of breakage of the fixing film.

Figure 7:
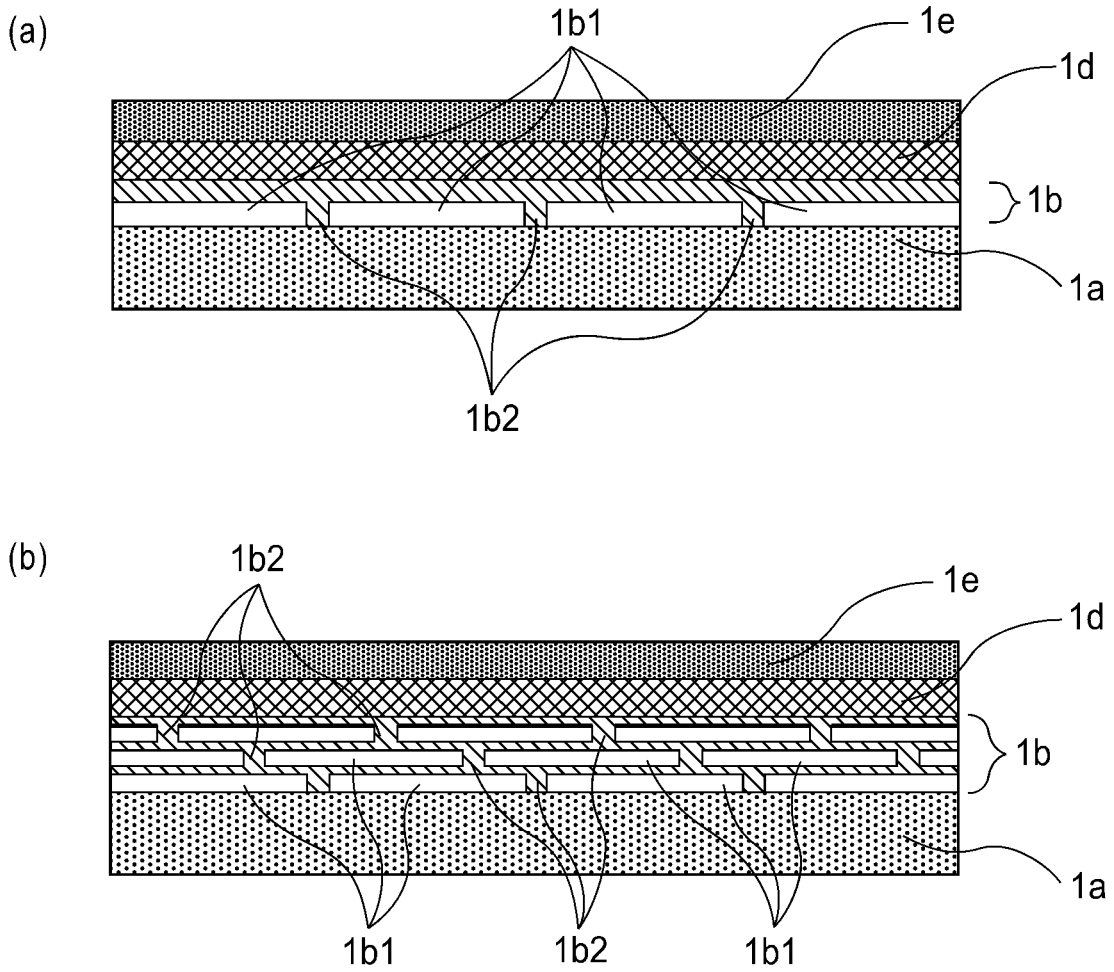

Parts (a) and (b) of FIG. 7 are sectional views of fixing films in a comparison example 1 and a comparison example 2.

Figure 8:
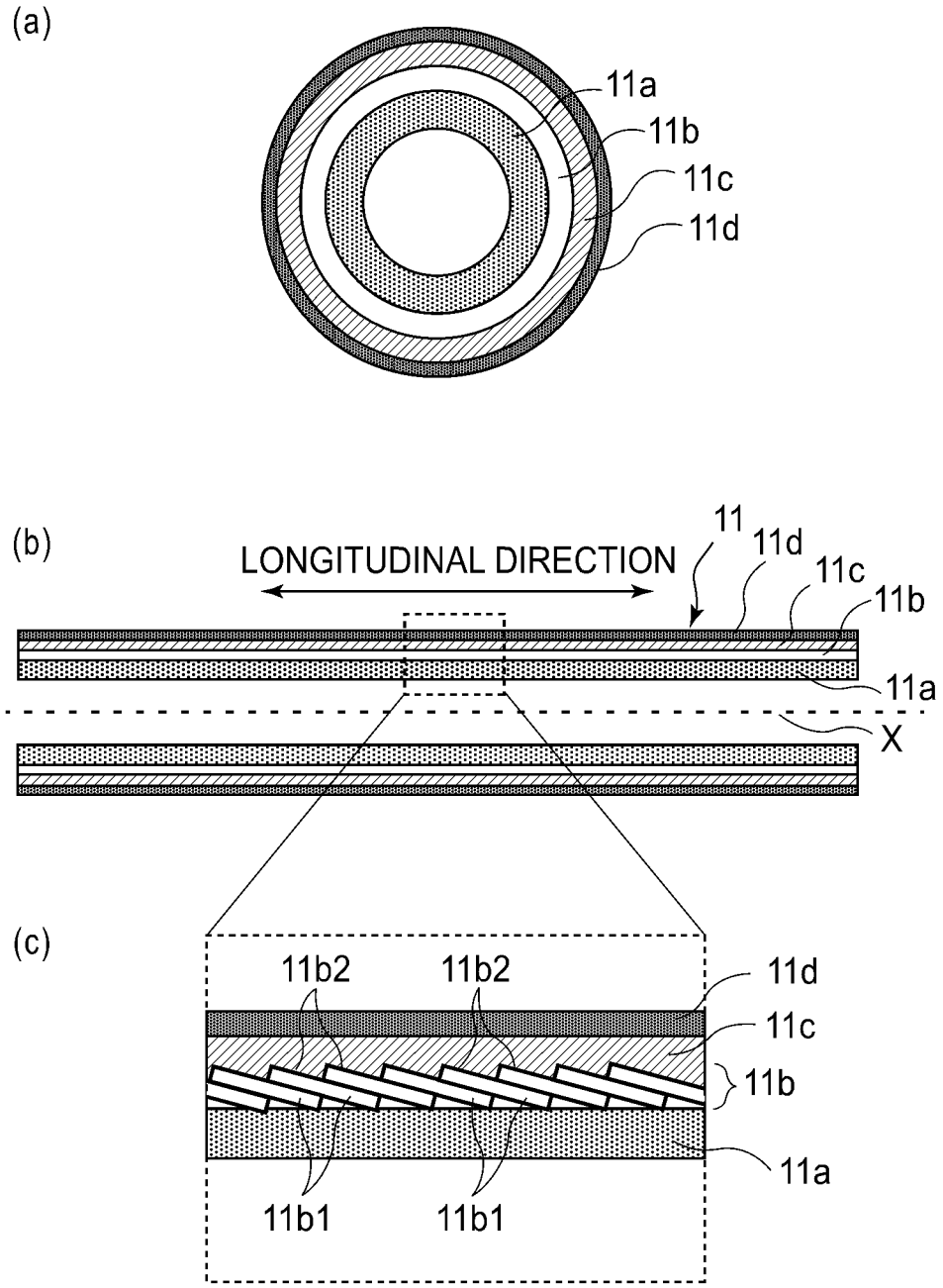

Parts (a), (b) and (c) of FIG. 8 are sectional views of a fixing film in a second embodiment.

Figure 9:
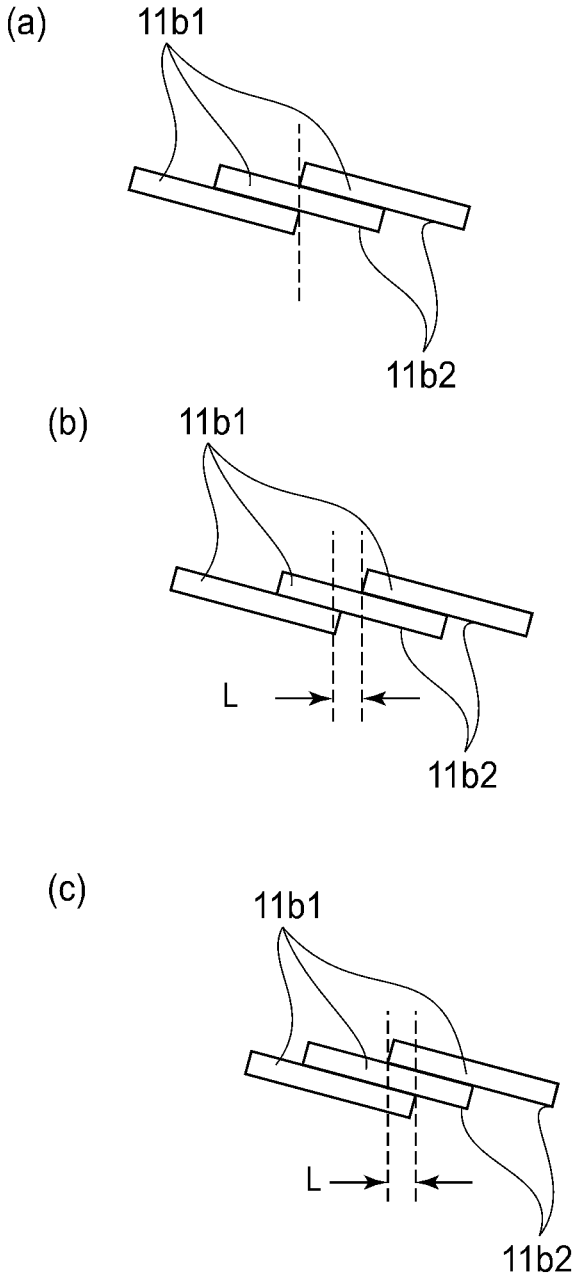

Parts (a), (b) and (c) of FIG. 9 are sectional views for illustrating a deviation L with respect to a longitudinal direction in the second embodiment.

Figure 10:
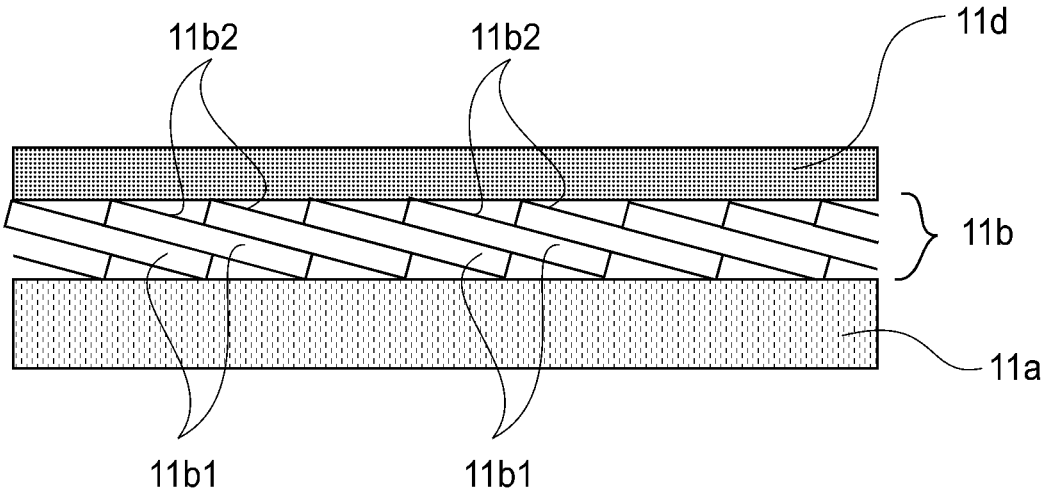

FIG. 10 is a sectional view of a fixing film in a comparison example 3.

Figure 11:
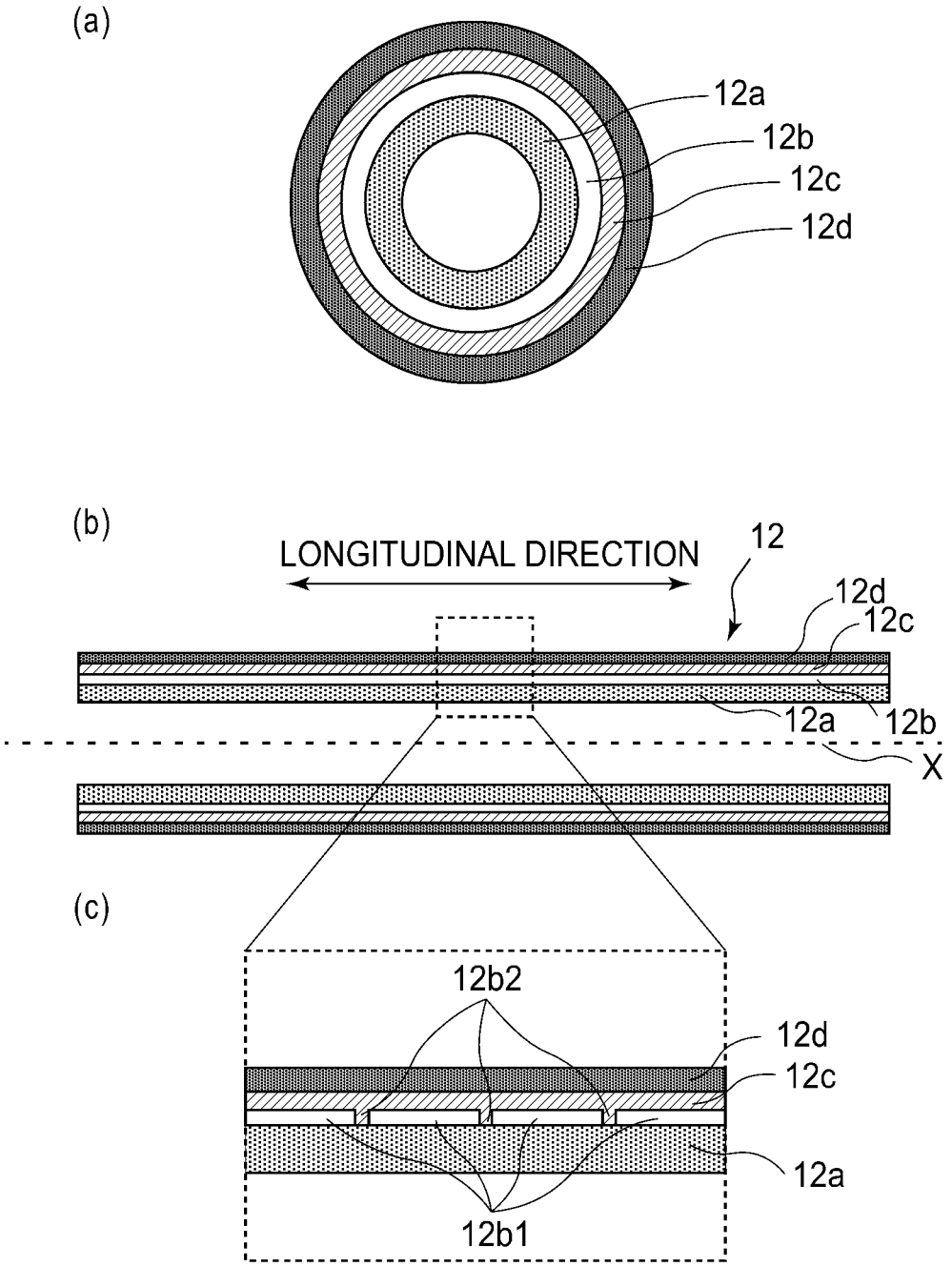

Parts (a), (b) and (c) of FIG. 11 are sectional views of a fixing film in a third embodiment.

DESCRIPTION OF EMBODIMENTS

In the following, embodiments of the present invention will be described with reference to the drawings.

First Embodiment (Image Forming Apparatus)

Figure 2:
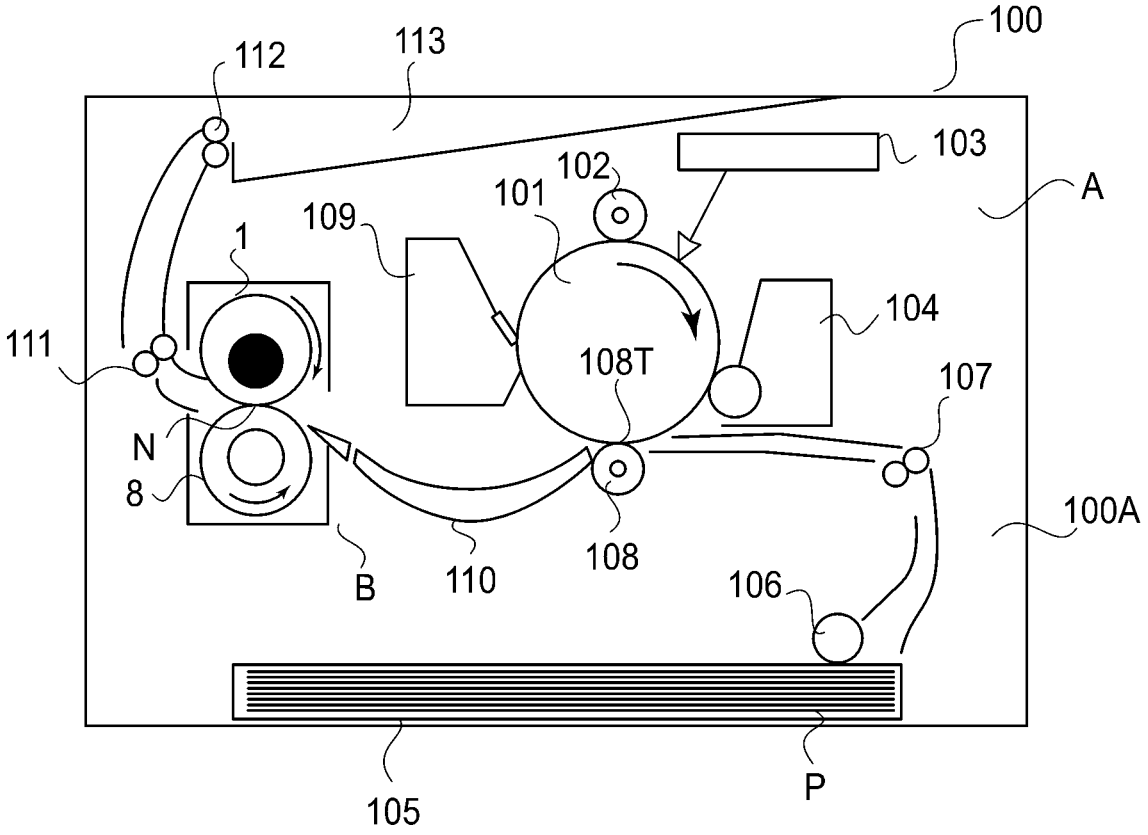
FIG. 2 is a sectional view of an image forming apparatus.

FIG. 2 is a sectional view of an image forming apparatus (a monochromatic printer using electrophotography) 100 in which a fixing device B as an image heating apparatus according to an embodiment of the present invention. In the image forming apparatus 100, an image forming portion A for forming a toner image on a recording material (recording medium, recording paper) P includes a photosensitive drum 101 as an image bearing member, a charging member 102, a laser scanner 103, a developing device 104, a cleaner 109 for cleaning the photosensitive drum 101, and a transfer member 108. An operation of the image forming portion A is well known, and therefor will be omitted from detailed description.

The recording material accommodated in a cassette 105 of an image forming apparatus main assembly 100A is fed one by one by rotation of a roller 106. The recording material P is fed by rotation of a roller pair 107 to a transfer nip 108T formed by the photosensitive drum 101 and the transfer member 108. The recording material P on which the toner image is transferred at the transfer nip 108T is sent to the fixing device B through a feeding guide 110, and the toner image is heated and fixed on the recording material P by the fixing device B. The fixing device B includes a fixing film 1 and a pressing roller 8 which form a fixing nip N as described specifically later.

Then, the recording material P coming out of the fixing device B is discharged onto a tray 113 by rotation of a roller pair 111 and a roller pair 112. (Image heating apparatus)

Figure 3:
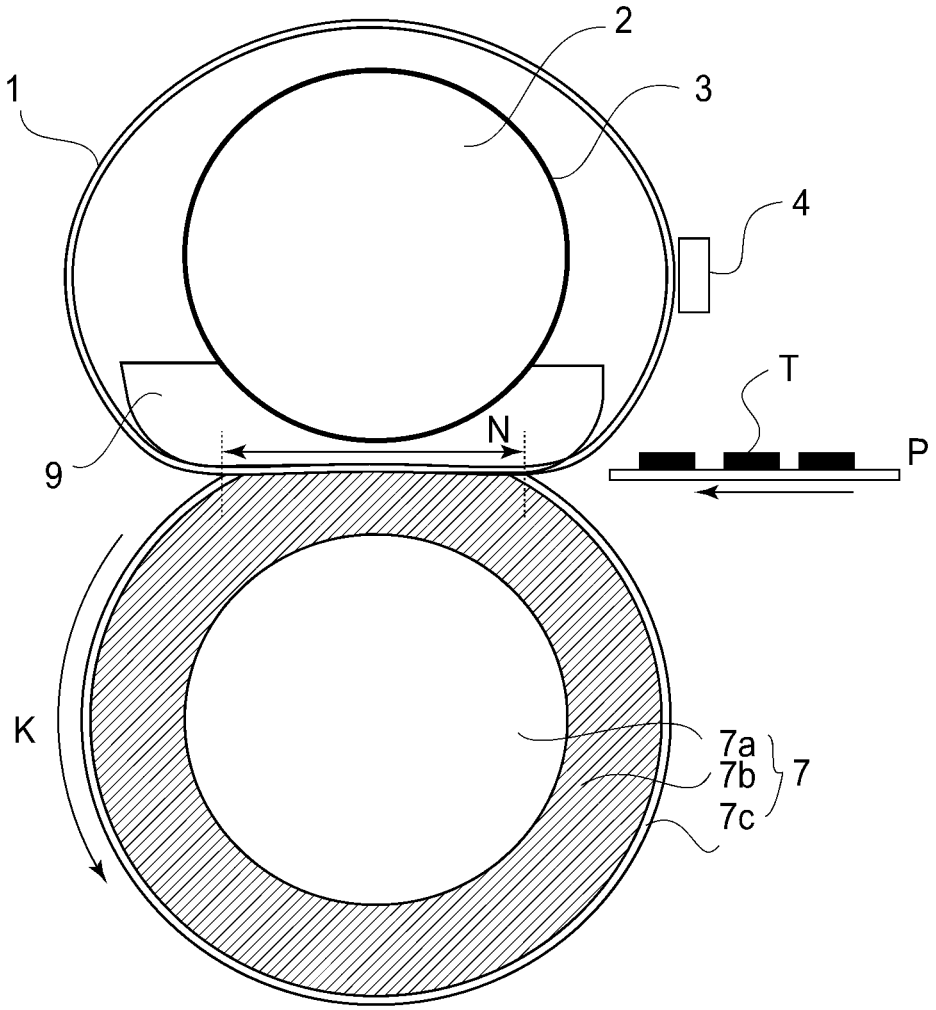
FIG. 3 is a front view of a fixing device B.

FIG. 3 is a schematic sectional view of the fixing device B as the image heating apparatus according to this embodiment of the present invention.

The fixing device B of this embodiment includes a cylindrical fixing film 1 rotatably supported and a pressing roller 7 as an opposing member which opposes the fixing film 1. Further, the fixing device B includes a nip forming member (film guide) 9 for forming the fixing nip N in cooperation with the pressing roller 7 through the fixing film 1. The nip forming member 9 is formed of a heat-resistant resin material, and also has a function of guiding rotation of the fixing film 1. Further, inside the fixing film 1, a coil unit in which an exciting coil 3 is wound around a magnetic core 2 is provided.

The pressing roller 7 includes a core metal 7*a*, an elastic layer 7*b* and a parting layer 7*c*. The pressing roller 7 is 30 mm in outer diameter. Further, between the pressing roller 7 and the film guide 9, a pressure of about 100 N-200 N (about 10 kgf-20 kgf) in total pressure is applied. By this constitution, the fixing nip N is formed. In the nip N, the recording material P on which the toner image T is carried is nipped and fed.

Incidentally, in FIG. 3, a temperature detecting element 4 for detecting a surface temperature of the fixing film 1 is provided.

Figure 1:
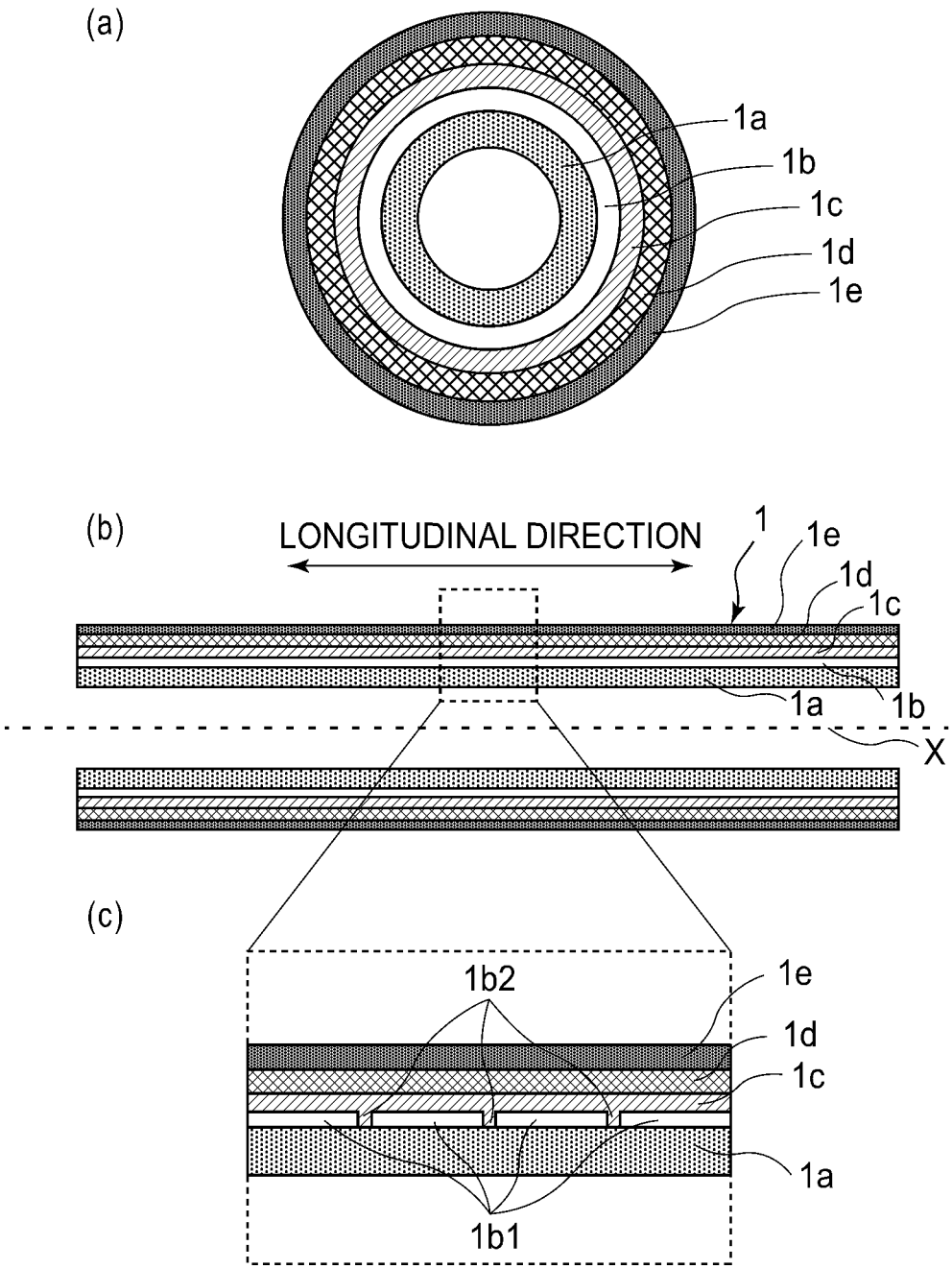

Part (a) of FIG. 1 is a sectional view of the fixing film 1 when the fixing film 1 is cut at a central portion with respect to a longitudinal direction of the fixing film 1. Part (b) of FIG. 1 is a sectional view of the fixing film 1 when the fixing film 1 is cut along the longitudinal direction of the fixing film 1. Part (c) of FIG. 1 is an enlarged view of a broken-line portion of part (b) of FIG. 1. The fixing film 1 is a cylindrical member of 10 mm-100 mm in diameter and includes, from an inside thereof, a base layer 1*a*, a heat generating layer 1*b*, a heat conductive layer 1*c*, an elastic layer 1*d* and a parting layer 1*e*. Further, in this embodiment, an outer diameter of the fixing film 1 was 30 mm.

As a material of the base layer 1*a* of the fixing film 1, a substance which has a non-material property and which is high in volume electric resistance is suitable. For example, resin materials represented by polyimide (PI), polyamide-imide (PAI) and the like, and fiber-reinforced resin materials represented by carbon fiber reinforced plastics (CFRP), glass fiber reinforced plastics (CFRP) and the like are used. Further, as a thickness of the base layer 1*a*, in the case where the resin material is used, 20-200 μm in which strength as the rotatable member, a sliding property by the nip N and rotation stability of the fixing film 1 can be easily obtained is suitable. In this embodiment, the base layer 1*a* was formed of the PI and was 60 μm in thickness.

In this embodiment, on an outer surface of the base layer 1*a*, the heat generating layer 1*b* is formed. As a material of the heat generating layer 1*b*, for example, metal low in volume electric resistance, such as gold, silver, copper, iron, platinum, tin, SUS, titanium, aluminum or nickel is suitable. In this embodiment, as the material of the heat generating layer 1*b*, silver was used, and a thickness of the heat generating layer 1*b* was 5 μm.

Further, the heat generating layer 1*b* is constituted by a plurality of divided heat generating elements 1*b*1 which are electrically divided elements with respect to a rotational axis direction (longitudinal direction) X of the fixing film 1. Each of the divided heat generating elements 1*b*1 has a ring shape as shown in part (a) of FIG. 6. Further, a dividing portion (insulating portion) 1*b*2 for electrically dividing (separating) adjacent divided heat generating elements also has a ring shape. The fixing device B of this embodiment has a constitution in which an induced current is generated so as to flow around the fixing film 1 in the circumferential direction, and is not of the type in which material flux is induced inside the heat generating layer 1*b*. For that reason, as the material of the heat generating layer 1*b*, it is possible to use a thin magnetic metal and a non-magnetic metal, which do not proved a magnetic path.

In the following, an example of a method of forming the heat generating layer 1*b* on the base layer 1*a* will be described. First, paint containing fine particles of the above-described metal and a polyimide precursor solution was prepared. The paint is applied onto the base layer 1*a* by means of blade coating, screen printing or the like, so that a coating (film) is formed. Incidentally, the base layer 1*a* is subjected to masking in advance of the coating of the paint so that a width (dimension) of each of the divided heat generating elements 1*b*1 with respect to the longitudinal direction of the fixing film 1 is 10 mm and so that a width, with respect to the longitudinal direction of the fixing film 1, of each of the dividing portions (insulating portions) each for dividing the adjacent divided heat generating elements is 300 μm.

Thereafter, the above-described coating (film) is gradually heated up to about 300-500° C. and thus is dried, so that imidization is caused to progress and thus the heat generating layer 1*b* is strongly bonded to the base layer 1*a*. By such a step, the heat generating layer 1*b* comprising the plurality of electrically divided heat generating elements 1*b*1 with respect to the rotational axis direction X are formed.

Next, on an outer surface side of the heat generating layer 1*b*, the heat conductive layer 1*c* is formed so as to contact the divided heat generating elements 1*b*1 or be close to the divided heat generating elements 1*b*1 through the coating film or the like. As a material of the heat conductive layer 1*c*, a material which is excellent in thermal conductivity (a layer which substantially does not generate heat is preferred and even when the layer generates heat, a heat generation amount thereof is lower than a heat generation amount of the divided heat generating elements 1*b*1) and which has an electrically insulating property is suitable. In the case where the heat conductive layer 1*c* substantially generates heat, when breakage such as a crack occurs in the heat conductive layer 1*c* with respect to the longitudinal direction of the fixing film 1, there is a possibility that local temperature rise of a broken end portion becomes more conspicuous.

As a substance having the electrically insulating property, it is possible to cite, for example, a resin material represented by PI, PAI, acrylic rein, epoxy resin, and the like. Further, a substance comprising the resin material as a main component and a heat conductive filler added and disposed in the resin material can be used in the heat conductive layer 1*c*.

As the heat conductive filler, an inorganic compound having both the heat conductive property and the electrically insulating property may preferably be used. For example, the heat conductive filler is capable of containing at least one kind of the inorganic compound selected from the group consisting of magnesium oxide (MgO), aluminum oxide ($Al_2O_3$), boron nitride (BN), aluminum nitride (AlN), silicon dioxide ($SiO_2$) and titanium oxide ($TiO_2$). From the viewpoints of the heat conductive property and ease of filling, the heat conductive filler may preferably contain at least one kind of the inorganic compound selected from the group consisting of MgO, $Al_2O_3$, BN and AlN.

As the resin material constituting the heat conductive layer 1*c*, an acrylic resin material which is a curable material capable of being cured by irradiation of heat or energy ray such as layer (ultraviolet (UV) ray or the like) or electron beam and which is obtained by curing an unsaturated double bond-containing acrylic copolymer is preferred. As the unsaturated double bond-containing acrylic copolymer, for example, an acrylic UV curable resin material ("OPSTAR Z7501", manufactured by JSR CORPORATION) can be used. In this embodiment, a material which contains the acrylic resin material as a main component and which contains AlN added and dispersed in the acrylic resin material is used.

An outline of a method of preparing the heat conductive layer 1*c* is as follows. In the unsaturated double bond-containing acrylic copolymer, AlN is added as the heat conductive filler and then is mixed and dispersed by an ultra-high pressure emulsifying and dispersing system, so that a coating liquid for forming the heat conductive layer is prepared. As a method of forming the heat conductive layer 1*c* on the heat generating layer 1*b* y using this coating liquid for forming the heat conductive layer, it is possible to cite an ordinary coating method, for example, dip coating, spray coating, roll coating, spin coating and the like. By using the coating method appropriately selected from these methods, it is possible to obtain the heat conductive layer 1*c* having a desired film (layer) thickness.

In this embodiment, the material of the heat conductive layer 1*c* has a high insulating property, and therefore, the dividing portions 1*b*2 which electrically divide the divided heat generating elements 1*b*1 are also formed of the same material.

On the outer surface of the heat conductive layer 1*c*, the elastic layer 1*d* comprising a silicone rubber or a fluorine-containing rubber is formed. In this embodiment, the elastic layer 1*d* of a silicone rubber of 20 degrees (JIS-A, 1 kg load) in hardness was formed in a thickness of about 200 μm.

On the outer surface of the elastic layer 1*d*, the parting layer 1*e* is formed for the purposes of preventing deposition of the toner on the fixing film 1 and an occurrence of the image defect. As a material of the parting layer 1*e*, a substance excellent in non-adhesiveness is suitable.

Figure 4:
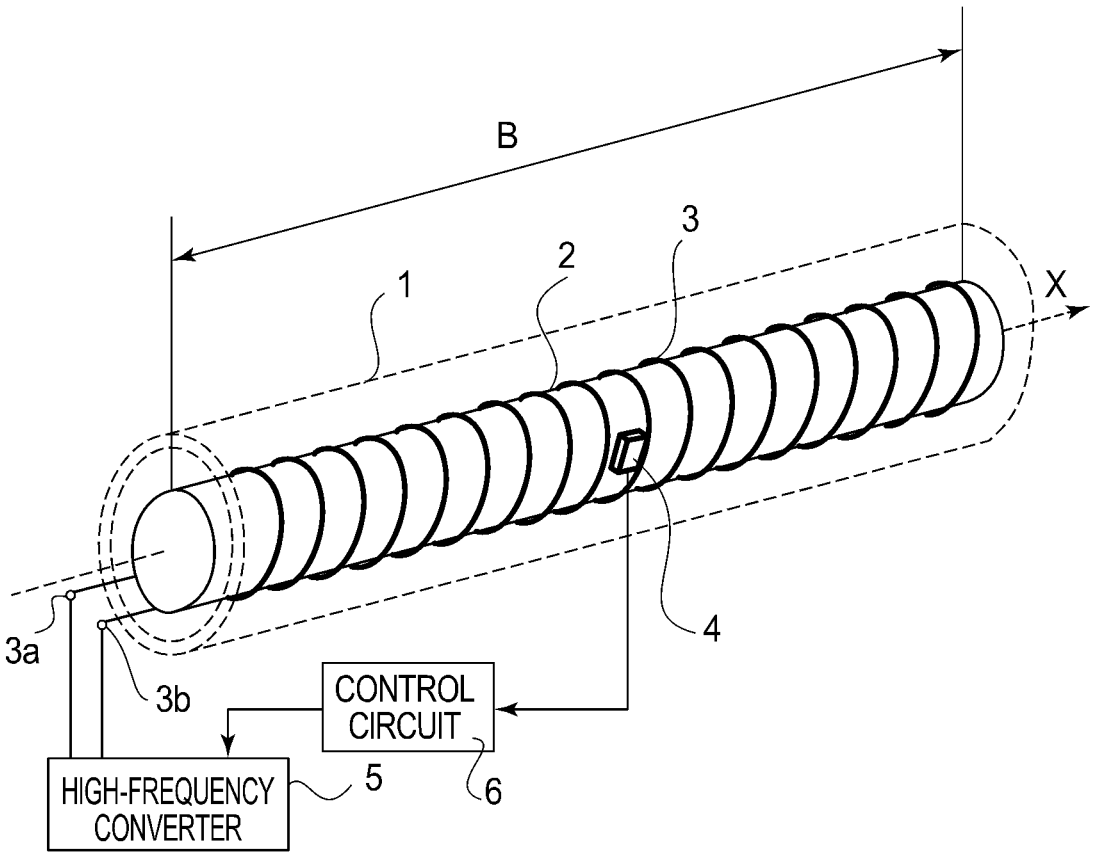
FIG. 4 is a perspective view of an exciting coil unit.

For example, polytetrafluoroethylene (PTFE), tetrafluoroethyl-perfluoroalkylene vinyl ether copolymer (PFA) and tetrafluoroethylene-hexafluoropropylene (FEP) are suitable. Or, tetrafluoroethylene-ethylene (ETFE), chlorotrifluoroethylene-ethylene (ECTFE) and the like are suitable. In this embodiment, as the parting layer 1*e*, a 15 μm-thick PFA tube was coated on the outer surface of the elastic layer 1*d*. FIG. 4 is a perspective view.

FIG. 4 is a perspective view of an exciting coil unit including the magnetic core 2 and the exciting coil 3. The magnetic core 2 has a cylindrical shape and is disposed at (inserted into) substantially central portion of the fixing film 1 by an unshown fixing means. Further, the magnetic core 2 functions as a member which induces magnetic lines of force (magnetic flux), by an alternating magnetic field generated by the exciting coil 3, to an inside (inner surface side) of the fixing film 1 and which forms a path (magnetic path) of the magnetic lines of force. The magnetic core 2 has a non-endless shape having opposite end portions at positions corresponding to one end portion and the other end portion of the fixing film 1 with respect to the longitudinal direction of the fixing film 1.

A material of this magnetic core 2 may desirably be a material which is small in hysteresis loss and which is high in relative permeability, and may preferably be a ferromagnetic material constituted by high-permeability oxide or alloy material, for example, calcined ferrite, ferrite resin material, amorphous alloy, permalloy or the like. Further, the magnetic core 2 may desirably have a cross-sectional area to the extent possible within a range in which the magnetic core 2 can be accommodated in the fixing film 1 which is a cylindrical member and was 5 mm-40 mm in diameter. The shape of the magnetic core 2 is not limited to the cylindrical shape, but a prism shape or the like can be selected.

In this embodiment, the magnetic core 2 has a constitution in which an open magnetic path is formed by being disposed only inside the fixing film 1, but may also employ a constitution in which a closed magnetic path is formed by disposing a core also on an outside of the fixing film 1 so as to extend around the fixing film 1 with respect to a circumferential direction.

Here, the exciting coil 3 is a line material, of 1-2 mm in diameter, obtained by coating a single conductor made of copper with heat-resistant polyamide imide, and is helically wound around the magnetic core 2 with the number of winding of about 10-30. In this embodiment, the number of winding is 18. The exciting coil 3 is wound around the magnetic core 2 inside the fixing film 1 with respect to a direction crossing a rotational axis, and therefore, when a high-frequency current (alternating current) is caused to flow through the exciting coil 3 via energization contacts 3*a* and 3*b*, a magnetic field (AC magnetic field) generates with respect to a direction (longitudinal direction) parallel to a rotation shaft X of the fixing film 1.

2) Image Heating Operation

When an image forming operation of the image forming apparatus 100 is started, the fixing device B heats the fixing film 1 through electromagnetic induction heating with predetermined timing and rotationally drives the pressing roller 7 in an arrow K direction (FIG. 3) by an unshown driving means. The fixing film 1 is in a follower rotation state in which a rotational force of the pressing roller 7 acts on the fixing film 1 due to a frictional force in the nip N.

A high-frequency converter 5 supplies a high-frequency current to the exciting coil 3 through the energization contacts 3*a* and 3*b*. A control circuit 6 controls the high-frequency converter 5 on the basis of a temperature detected by the temperature detecting element 4 for detecting a surface temperature of the fixing film 1. As a result, the fixing film 1 is heated through the electromagnetic induction heating, so that the surface temperature of the fixing film 1 is maintained and adjusted at a predetermined target temperature (about 150° C.-200° C.).

3) Heat Generation Principle of Fixing Film 1

Part (a) of FIG. 5 is a sectional view showing a current (induced current) flowing through the fixing film 1 and a magnetic field formed by the exciting coil 3, and part (b) of FIG. 5 is a perspective view of part (a) of FIG. 5. In part (a) of FIG. 5, for convenience, the heat generating layer 1*b*, the magnetic core 2 and the exciting coil 3 are concentrically disposed. In the figure, with respect to Y-axis direction, magnetic lines of force directed toward a rear (depth) direction on the drawing sheet are represented by "Bin" (X mark in circle), and magnetic lines of force directed toward a front direction on the drawing sheet are represented by "Bout" (black dot in circle).

In part (a) of FIG. 5, at the moment when a current increases in the exciting coil 3 with respect to a direction of an arrow I, magnetic lines of force directed the rear direction on the drawing sheet are formed in the magnetic core 2. At this time, assuming that the number of the magnetic lines of force (Bin) directed, toward the rear direction on the drawing sheet, in the magnetic core 2 which is an inside of the heat generating layer 1*b* is 8 lines, in the fixing device B of this embodiment, the same number (8 lines) of the magnetic lines of force (Bout) which are returned outside the heat generating layer 1*b* in the frontward direction on the drawing sheet are formed. That is, the magnetic lines of force which pass through the inside of the magnetic core 2 and which come out of opposite ends of the magnetic core 2 do not enter the inside of the magnetic core 2 but pass through the outside of the heat generating layer 1*b* with respect to a radial direction of the fixing film 1. In actuality, when the AC magnetic field is formed, induced electromotive force is applied to the heat generating layer 1*b* in an entire region with respect to the circumferential direction so as to cancel the thus-formed magnetic lines of force, so that a circumferential current I flowing around the heat generating layer 1*c* in the circumferential direction flow as indicated by an arrow. Incidentally, a constitution in which 90% or more of the magnetic flux generated from the opposite ends of the magnetic core 2 by the exciting coil unit pass through the outside of the fixing film 1 with respect to the radial direction of the fixing film 1 may preferably be employed.

The induced electromotive force is applied to the heat generating layer 1*b* with respect to the circumferential direction, so that the circumferential current I uniformly flows through the inside of each of the divided portions of the heat generating layer 1*h*. Then, the magnetic lines of force repeat direction reversal of generation and extinction by the high-frequency current, and therefore, the circumferential current J repeats direction reversal of generation and extinction in synchronism with the high-frequency current. When the current flows through the heat generating layer 1*b*, Joule heat generates by electric resistance of the heat generating layer 1*b*.

A heat generation amount Pe of the Joule heat is represented by the following formula (1):

$$Pe = ke\frac{(tfBm)^2}{\rho} \quad (1)$$

Pe: heat generation amount t: through of heat generating layer f: frequency

Bm: maximum magnetic flux density p: resistivity ke: constant of proportionality Incidentally, the magnetic lines of force generated by the magnetic core 2 generate in parallel to the rotational axis of the fixing film 1, and therefore, the circumferential current J flows in a direction perpendicular to the axial direction. Accordingly, the circumferential current J flows through each of the divided heat generating elements 1*b*1 which are formed by electrically dividing the heat generating layer 1*b* with respect to the longitudinal direction. The fixing device B of this embodiment is capable of generating heat with high efficiency even in both the case where the thin magnetic metal is employed as the material of the heat generating layer 1*b* and the case where the non-magnetic metal is employed as the material of the heat generating layer 1*b*. Further, in a range in which a resistance value is not extremely changed, the heat generation efficiency does not depend on a thickness of the material. Further, the fixing device B is capable of generating heat even in the case where an electroconductive resin material other than the metal material is used.

4) Overheating of Heat Generating Layer Due to Breakage

Parts (a) and (b) of FIG. 6 are schematic views for illustrating a flow of the current in the case where breakage occurs in the heat generating layer 1*b*. Part (a) of FIG. 6 shows the case where the fixing film 1 in this embodiment is used, and part (b) of FIG. 6 shows a comparison example and the case where a fixing film 1 in which a heat generating layer is not divided with respect to the longitudinal direction of the fixing film is used. Further, for each of the fixing films 1, a manner of the flow of the current in the case where a broken portion (region) ("Z2") generated at a part of the fixing film 1 with respect to the longitudinal direction is shown.

In a region ("Z1") in which there is no broken portion, the induced electromotive force is generated in the fixing film 1 by magnetic flux extending in the axial direction through the magnetic core 2, so that as shown by arrows in parts (a) and (b) of FIG. 6, the current flows around the fixing film 1 in the circumferential direction (in actuality, the current also flows in an opposite direction to the direction of the arrows since an AC voltage is applied).

Here, in the broken region ("Z2, the current flowing in the circumferential direction makes a detour and thus moves around an end (broken end) C of the broken region. In part (b) of FIG. 6 showing the comparison example, the current flows through the broken end C in a large amount, so that overheating occurs compared with another region. On the other hand, as shown in part (a) of FIG. 6, in this embodiment in which the heat generating layer 1*b* is constituted by the electrically divided heat generating elements 1*b*1, the amount of the current flows through the broken end C while making the detour becomes small, so that the overheating can be suppressed.

5) Effect of Heat Conductive Layer

In the constitution in which the heat generating layer is divided, the dividing portions 1*b*2 do not generate heat and therefore, in the case of the constitution in which there is not heat conductive layer 1*c*, temperature nonuniformity occurs with respect to the longitudinal direction, so that an image defect (uneven glossiness) such that gloss is different between a position of the recording material passed through the dividing portions and a position of the recording material passed through the heat generating layer portions occurs. On the other hand, in this embodiment, as shown in part (c) of FIG. 1, the heat conductive layer 1*c* is provided, so that heat generation distribution non-uniformity due to the divided heat generating elements is suppressed and thus suppression of the uneven glossiness is realized. In order to show such an effect, a result of comparison and investigation conducted in the following manner will be described.

Part (a) of FIG. 7 shows a comparison example 1 employing a constitution in which there is no heat conductive layer and a single heat generating layer is formed and in which divided heat generating elements 1*b*1 are coated with only an acrylic resin material. Part (b) of FIG. 7 shows a comparison example 2 employing a constitution in which there is no heat conductive layer and a laminated heat generating layer and in which positions of dividing portions 1*b*2 do not overlap with each other with respect to the longitudinal direction of the fixing film 1.

The laminated heat generating layer in part (b) of FIG. 7 includes three layers formed by successively applying paste-like metal layers on the outer surface of the base layer 1*a* while subjecting the metal layers to masking (process) and insulation (process). That is, first, a 5 μm-thick metal layer (first layer) is formed on the base layer 1*a* with a longitudinal width (interval) of 10 μm, and thereafter is subjected to the insulation process to form dividing portions 1*b*2. Next, a 5 μm-thick metal layer (second layer) is formed with a longitudinal width of 10 μm so that dividing portions 1*b*2 shift from the dividing portions 1*b*2 of the first layer. Further, similarly, a 5 μm-thick metal layer (third layer) is formed with a longitudinal width of 10 μm so that dividing portions 1*b*2 shift from the dividing portions 1*b*2 of the second layer.

Table 1 shows a result of check with eye observation of a state of an occurrence of uneven glossiness in the case where a width (with respect to the longitudinal direction of the fixing film 1 of each of the dividing portions 1*b*2 is changed using the divided heat generating elements 1*b*1 each having the width of 10 mm in each of the comparison example 1, comparison example 2 and this embodiment (the embodiment 1).

TABLE 1

| | Width of dividing portion | | | |
|---|---|---|---|---|
| | 700 μm | 500 μm | 300 μm | 100 μm |
| COMP. EX. 1 | X | X | Δ | ○ |
| COMP. EX. 2 | X | Δ | Δ | ○ |
| EMB. 1 | Δ | ○ | ○ | ○ |

X: Occurrence level of cleaner uneven glossiness
Δ: Occurrence level of slight uneven glossiness
○: No occurrence of uneven glossiness As shown in Table 1, in the constitution of the comparison example 1 in which there is no heat conductive layer, although the width of the dividing portion 1*b*2 is 300 μm, slight uneven glossiness occurs. Also in the constitution of the comparison example 2 in which the divided heat generating elements 1*b*1 are laminated, slight uneven glossiness occurs in the cases of the dividing portion widths of 300 μm and 500 μm.

Here, in the heat conductive layer 1*c* in this embodiment, the filler high in thermal conductivity is added and dispersed, and therefore, thermal conductivity of the heat conductive layer 1*c* is 3 W/mK. The thermal conductivity of the elastic layer 1*d* is 1.4 W/mK, so that the thermal conductivity of the heat conductive layer 1*c* is about twice the thermal conductivity of the elastic layer 1*d*. The thermal conductivity of the heat conductive layer 1*c* may preferably be twice or more the thermal conductivity of the elastic layer 1*d*.

For that reason, although heat is not generated in the dividing portions 1*b*2 (part (c) of FIG. 1), the temperature of an entirety of the heat conductive layer 1*c* becomes substantially uniformly, so that the occurrence of the uneven glossiness can be suppressed even when the width of the dividing portion 1*b*2 with respect to the longitudinal direction of the fixing film 1 is 500 ||m. Incidentally, the thermal conductivity of the heat conductive layer 1*c* is adjustable by the addition amount of the heat conductive filler added and dispersed.

Further, as a method of increasing the thermal conductivity of the resin material which is the main component of the heat conductive layer 1*c*, for example, a high-order structure control epoxy resin having mesogen structure is used as the main component, so that the thermal conductivity can be increased up to about 10 W/mK. Although the thermal conductivity of the elastic layer 1*d* varies depending on the structure thereof, from study in the constitution of this embodiment, it is preferable that the thermal conductivity of the heat conductive layer 1*c* is at least 3 W/mK and has a ratio, to the thermal conductivity of the elastic layer 1*d*, of 2 or more from the viewpoint of suppressing the occurrence of the image defect due to the uneven glossiness.

In this embodiment, although the heat conductive layer 1*c* is formed so as to contact the divided heat generating elements 1*b*1, a similar effect can be obtained by, for example, subjecting the surfaces of the divided heat generating elements 1*b*1 to the insulation process through formation of an oxide film or the like and then by forming the heat conductive layer 1*c*.

By employing the constitution of this embodiment, manufacturing tolerance of the width of the dividing portion 1*b*2 when the heat generating layer 1*b* is formed can be alleviated, and therefore, it becomes possible to ensure stable mass-productivity.

Further, the occurrence of the uneven glossiness can be suppressed without laminating the heat generating layer 1*b*, and therefore, the heat generating layer 1*b* can be made thin using a single heat generating layer 1*b*. Accordingly, in that case, thermal capacity of the fixing film 1 can be decreased, so that it becomes possible to employ a constitution which is high in temperature rising speed, which is excellent in quick start property and which is advantageous in shortening of print waiting time.

Second Embodiment

In the following, a second embodiment of the present invention will be described. A fixing film 11 of this embodiment includes, in place of the heat generating layer 1*b* of the fixing film 1 in the first embodiment, a heat generating layer 11*b* formed by laminating metal layers each subjected to insulation process at a peripheral surface thereof. The members such as the magnetic core 2, the exciting coil 3, the pressing roller 7 and the like having the same constitution as those in the first embodiment will be omitted from description.

Parts (a), (b) and (c) of FIG. 8 are sectional views of the fixing film 11 in this embodiment. Part (a) of FIG. 8 is the sectional view of the fixing film 11 with respect to a widthwise direction, part (b) of FIG. 8 is the sectional view of the fixing film 11 with respect to a longitudinal direction, and part (c) of FIG. 8 is an enlarged view of a broken line portion of part (b) of FIG. 8.

The fixing film 11 in this embodiment includes a base layer 11*a*, a heat generating layer 11*b* formed on an outer surface of the base layer 11*a*, a heat conductive layer 11*c* formed on an outer surface of the heat generating layer 11*b*, and a parting layer 11*d* formed on an outer surface of the heat conductive layer 11*c*. Incidentally, in this embodiment in which thin metal layers are laminated, a constitution in which the elastic layer 1*d* described in the first embodiment is not provided so as not to decrease the temperature rising speed of the fixing film 11, i.e., so as not to increase the thickness of the fixing film 11 is employed. The base layer 11*a*, the heat conductive layer 11*c* and the parting layer 11*d* are similar to those in the first embodiment, respectively.

The heat generating layer 11*b* is formed by a plurality of thin metal layers 11*b*1 as divided heat generating elements. That is, the heat generating layer 11*b*1 is obtained by laminating ring-shaped thin metal layers 11*b*1 coated, at a peripheral surface thereof, with an insulating layer (coat layer 11*b*2). Specifically, on the outer surface of the base layer 11*a*, the thin metal layers 11*b*1 are successively laminated so as to overlap with a part of an adjacent one thereof As shown in part (c) of FIG. 8, each of the ring-shaped thin metal layers 11*b*1 is formed of a tapered metal foil which has a width of 10 mm and a thickness of 5 μm and which is inclined with respect to a rotational axis direction X. During overlapping, a total thickness of the heat generating layer 11*b* constituted by the two thin metal layers 11*b*1 is made the same with respect to the longitudinal direction of the fixing film 11.

Incidentally, in part (c) of FIG. 8, for convenience, a stepped portion of the overlapping two thin metal layers 11*b*1 is shown in an exaggerated manner, but in actuality, the heat generating layer 11*b* is constituted by the thin metal layers 11*b*1, and therefore, a degree of unevenness of the stepped portion of the heat generating layer 11*b* is small.

The fixing device B of this embodiment has the constitution in which the heat generating layer 11*b* of the fixing film 11 includes a plurality of electrically divided heat generating elements 11*b*1 with respect to the rotational axis direction X, and therefore, overheating can be suppressed even in the case where a broken portion such as a crack is generated in the heat generating layer 11*b*.

Here, with reference to FIG. 9, a deviation L, with respect to the longitudinal direction of the fixing film 11, occurring when the thin metal layers 11*b*1 are formed so as to overlap with each other will be described. As shown in part (a) of FIG. 9, when the thin metal layers 11*b*1 can be formed with no deviation ideally, the heat generating layer 11*b* is constituted, so that the thickness thereof is the same with respect to the longitudinal direction of the fixing film 11. For that reason, temperature nonuniformity of the fixing film 11 with respect to the longitudinal direction can be suppressed. However, in the case where the deviation L generated due to the manufacturing tolerance, there is a possibility that an overlapping amount between the thin metal layers 11*b*1 is deviated in a decreasing direction as shown in part (b) of FIG. 9 and there is a possibility that the overlapping amount between the thin metal layers 11*b*1 is deviated in an increasing direction as shown in part (c) of FIG. 9.

In the case of parts (b) and (c) of FIG. 9, the overlapping amount between the thin metal layers is different, and therefore, the thickness of the heat generating layer 11*b* is different with respect to the longitudinal direction of the fixing film 11, so that there is a possibility that the temperature nonuniformity occurs. Particularly, in the case of the constitution in which the elastic layer is not provided as in this embodiment, there is a possibility that uneven glossiness due to temperature nonuniformity occurs. In the following, the deviation L is negative with respect to an overlapping decreasing direction and is positive with respect to an overlapping increasing direction.

In this embodiment, the heat conductive layer 11*c* is provided so as to suppress the occurrence of the uneven glossiness due to the temperature nonuniformity. In order to demonstrate an effect of the heat conductive layer 11*b*, Table 2 shows a result of comparison and investigation between this embodiment (embodiment 2) in which the heat conductive layer 11*c* is provided and a comparison example (comparison example 3) in which the heat conductive layer 11*c* is not provided. In Table 2, a result of check with eye observation of a state of an occurrence of uneven glossiness in the case where the deviation L is changed using the thin metal layers 11*b*1 each having the width of 10 μm.

TABLE 2

| | Deviation L [μm] | | | | | |
|---|---|---|---|---|---|---|
| | 500 | 300 | 100 | −100 | −300 | −500 |
| COMP. EX. 1 | x | x | Δ | Δ | x | x |
| EMB. 2 | Δ | ○ | ○ | ○ | ○ | Δ |

x: Occurrence level of cleaner uneven glossiness
Δ: Occurrence level of slight uneven glossiness
○: No occurrence of uneven glossiness As shown in Table 2, in the constitution of the comparison example 3 in which there is no heat conductive layer, in the case where the deviation L is positive, the temperature becomes high at a portion where three thin metal layers 11*b*1 overlap with each other, so that uneven glossiness such that gloss on the recording material passed through the overlapping portion becomes high occurs. Further, in the case where the deviation L is negative, the temperature becomes low at a portion where the single thin metal layer 11*b*1 is formed, so that uneven glossiness such that the gloss becomes low occurs.

On the other hand, in this embodiment, the thermal conductivity of the heat conductive layer 11*c* is 3 W/mK, and the thermal conductivity of the parting layer 11*d* using PFA tube is 0.24 W/mK, so that the heat conductive layer 11*c* has the thermal conductivity which is about 12 times of the thermal conductivity of the parting layer 11*d* adjacent to the heat conductive layer 11*c* with respect to a radial direction. For that reason, in the constitution in which the heat conductive layer is provided, the temperature of an entirety of the heat conductive layer 11*c* becomes substantially uniform, and in a range of −300 μm to +300 μm, the occurrence of the uneven glossiness cannot be observed with eyes, so that an occurrence of an image defect due to thickness non-uniformity of the heat generating layer 11*b* is suppressed.

Further, by forming the heat conductive layer 11*c*, the deviation L can be increased to ±300 μm (range: 600 μm), so that even when a manufacturing variation or the like is taken into consideration, stable mass-productivity can be ensured.

Third Embodiment

In the following, a third embodiment of the present invention will be described.

Part (a) of FIG. 11 is a sectional view of a fixing film 12 with respect to a widthwise direction, part (b) of FIG. 11 is a sectional view of the fixing film 12 with respect to a longitudinal direction, and part (c) of FIG. 11 is an enlarged view of a broken line portion of part (b) of FIG. 11.

In this embodiment, as a base layer of the fixing film 12, in place of the base layer 1*a* in the first embodiment, a heat conductive base layer 12*a* also functioning as a heat conductive layer is used.

Further, the fixing film 2 in this embodiment includes, as shown in FIG. 11, the heat conductive base layer 12*a*, a heat generating layer 12*b* formed on an outer surface of the heat conductive base layer 12*a*, an elastic layer 12*c* formed on an outer surface of the heat generating layer 12*b*, and a parting layer 12*d* formed on an outer surface of the elastic layer 12*c*. The heat generating layer 12*b*, the elastic layer 12*c* and the parting layer 12*d* are similar to the heat generating layer 1*b*, the elastic layer 1*c* and the parting layer 1*d*, respectively, in the first embodiment. Incidentally, members such as the magnetic core 2, the exciting coil 3, the pressing roller 7 and the like having the same constitution as those of the fixing device B in the first embodiment will be omitted from description.

As a material constituting the heat conductive base layer 12*a* functions as the base layer and the heat conductive layer, for example, a resin material such as PI, polyamide or PEEK is used. These resin materials may also be used in mixture of two or more kinds. Further, the heat conductive base layer 12*a* can be obtained by molding through appropriate selection of a molding method in which a heat conductive filler is added in the above-described resin material and is subjected to inflation molding, cylindrical injection molding, injection stretch blow molding (forming) or the like.

In this embodiment, the heat conductive base layer 12*a* was formed by adding alumina fibers into a polyimide resin material and then by subjecting the resin material to the cylindrical injection molding. By using the injection molding, the alumina fibers are oriented in a longitudinal direction of the fixing film 12. Further, by the heat conductive base layer 12*a*, heat of divided heat generating elements 12*b*1 of the heat generating layer 12*b* is conducted in the longitudinal direction of the fixing film 12, so that the temperature of the heat conductive base layer 12*a* becomes substantially uniform with respect to the longitudinal direction of the fixing film 12 and thus temperature nonuniformity at dividing portions 12*a*2 can be suppressed.

In the constitution of this embodiment, the base layer also functions as the heat conductive layer, and therefore, there is no need to form the base layer and the heat conductive layer as separate layers, so that a thickness of the fixing film 12 can be made thin. Accordingly, thermal capacity of the fixing film 12 can be made small, so that it becomes possible to employ a constitution which is high in temperature rising speed, which is excellent in quick start property and which is advantageous in shortening of print waiting time.

Other Embodiments

The above-described embodiments are preferred embodiments, but the present invention is not limited thereto and can be variously modified and changed within the scope of the present invention. For example, the image heating apparatus according to the present invention is not limited to the above-described fixing devices, but may also be effectively used an image modifying apparatus for modifying glossiness or the like of an image once fixed on the recording material (fixed image) or a tentatively fixed image (half fixed image). Further, an opposing member which opposes the fixing film is not limited to the pressing roller 7 but may also be an endless belt.

Further, in the above-described first and third embodiments, the single heat generating layer 1*b* and the single heat generating layer 12*b* are provided, respectively, while in the above-described second embodiment, the plurality of heat generating layers 11*b* are provided with respect to the thickness direction, so that in the present invention, the heat generating layer may only be required to be provided in the form of one or more layer. That is, for example, in the first and third embodiments, as shown in part (b) of FIG. 7, a plurality of heat generating layers (in which dividing portions do not overlap with each other with respect to the longitudinal direction) may also be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-165361 filed on Sep. 4, 2018, which is hereby incorporated by reference herein in its entirety.

What is claimed is;:

1. A cylindrical film for use with an image heating apparatus, comprising:

a cylindrical base layer made of a polyimide, a polyamideimide, a carbon fiber reinforced plastic, or a glass fiber reinforced plastic;

a plurality of heat generating layers configured to generate heat by a flow of current, wherein each of the heat generating layers has a ring shape and is arranged on the base layer along a longitudinal direction of the film;

a ring-shaped insulating portion configured to electrically insulate the heat generating layers adjacent to each other; and a heat conductive layer different from a layer of the heat generating layers with respect to a thickness direction of the film, wherein the heat conductive layer is electrically insulative, and wherein the heat conductive layer is 3 W/mK or more in thermal conductivity and overlaps with the heat generating layers with respect to the longitudinal direction of the film.

2. The cylindrical film according to claim 1, wherein the heat conductive layer also functions as the insulating portion.

3. The cylindrical film according to claim 2, wherein the heat conductive layer comprises:

at least one resin material selected from the group consisting of a polyimide, a polyamideimide, an acrylic resin,. and an epoxy resin; and at least one heat conductive filler selected from the group consisting of magnesium oxide, aluminum oxide, boron nitride, aluminum nitride, silicon dioxide,. and titanium oxide, and wherein the heat conductive filler is dispersed in the resin material.

4. The cylindrical film according to claim 1, wherein the heat conductive layer is provided outside the heat generating layers with respect to the thickness direction of the film.

5. The cylindrical film according to claim 1, wherein the heat conductive layer is provided inside the heat generating layers with respect to the thickness direction of the film.

6. An image heating apparatus for heating an image formed on a recording material, comprising:

a cylindrical film rotatable while contacting the recording material;

a roller contacting an outer surface of the film and configured to form a nip, in which the recording material is nipped and fed, between itself and the film; and an exciting coil unit configured to generate an induced current flowing through the film in a circumferential direction, wherein the film includes:

a cylindrical base layer made of a polyimide, a polyamideimide, a carbon fiber reinforced plastic, or a glass fiber reinforced plastic;

a plurality of heat generating layers configured to generate heat by a flow of the induced current, wherein each of the heat generating layers has a ring shape and is arranged on the base layer along a longitudinal direction of the film;

a ring-shaped insulating portion configured to electrically insulate the heat generating layers adjacent to each other; and a heat conductive layer different from a layer of the heat generating layers with respect to a thickness direction of the film, wherein the heat conductive layer is electrically insulative, and wherein the heat conductive layer is 3 W/mK or more in thermal conductivity and overlaps with the heat generating layers with respect to the longitudinal direction of the film.

7. The image heating apparatus according to claim 6, wherein the heat conductive layer also functions as the insulating portion.

8. The image heating apparatus according to claim 7, wherein the heat conductive layer comprises:

at least one resin material selected from the group consisting of a polyimide, a polyamideimide, an acrylic resin, and an epoxy resin; and at least one heat conductive filler selected from the group consisting of magnesium oxide, aluminum oxide, boron nitride, aluminum nitride, silicon dioxide, and titanium oxide, and wherein the heat conductive filler is dispersed in the resin material.

9. The image heating apparatus according to claim 6, wherein the heat conductive layer is provided outside the heat generating layers with respect to the thickness direction of the film.

10. The image heating apparatus according to claim 6, wherein the heat conductive layer is provided inside the heat generating layers with respect to the thickness direction of the film.

11. The image heating apparatus according to claim 6, wherein the sexciting coil unit is provided in an inner space of the film, wherein the exciting coil unit includes an exciting coil having a helical axis parallel to the longitudinal direction of the film and a core provided in the exciting coil along the longitudinal direction of the film, wherein the core has a non-endless shape having end portions at positions corresponding to one end portion and another end portion, respectively, of the film with respect to the longitudinal direction of the film, and wherein 90% or more of magnetic flux generated from opposite ends of the core by the exciting coil unit passes through an outside of the film with respect to a radial direction of the film.

* * * * *